United States Patent [19]

Jenkins

[11] Patent Number: 4,953,255

[45] Date of Patent: Sep. 4, 1990

[54] PORTABLE HOT ASH VACUUM

[76] Inventor: Overton S. Jenkins, 6206 Sedgefield Dr., Norfolk, Va. 23513

[21] Appl. No.: 324,443

[22] Filed: Mar. 16, 1989

[51] Int. Cl.[5] ..... A47L 5/36

[52] U.S. Cl. ..... 15/327.02; 15/352; 15/422

[58] Field of Search ..... 15/327 R, 327 F, 352, 15/353, 422; 126/242

[56] References Cited

U.S. PATENT DOCUMENTS

| | | | |
|---|---|---|---|
| 2,239,010 | 4/1941 | McMillan | 406/100 |
| 2,487,689 | 11/1949 | Black | 126/242 X |
| 2,529,965 | 11/1950 | Rentz | 126/242 |
| 2,531,920 | 11/1950 | Raminger | 15/422 |
| 4,342,131 | 8/1982 | Reid | 15/327.10 |
| 4,497,308 | 2/1985 | Johnson | 15/327 F X |
| 4,571,250 | 2/1986 | Irmscher et al. | 55/359 |
| 4,704,764 | 11/1987 | Metel Ko | 126/242 |
| 4,735,189 | 4/1988 | Murphy et al. | 126/242 |

FOREIGN PATENT DOCUMENTS

| | | | |
|---|---|---|---|
| 421664 | 12/1932 | United Kingdom | 15/327 R |
| 653033 | 9/1951 | United Kingdom | 15/327 X |

*Primary Examiner*—Chris K. Moore

*Attorney, Agent, or Firm*—John K. Donaghy

[57] ABSTRACT

A hot ash vacuum is provided with a canister having an outer housing and a concentric inner housing; a cap for the canister has a vacuum motor extending into the inner housing; a flexible hose is coupled through the cap and communicates with the inner housing at one end and a nozzle at the other end; and a dust collector communicating through the cap with said inner housing for collecting hot ash dust therefrom.

6 Claims, 2 Drawing Sheets

FIG. 3
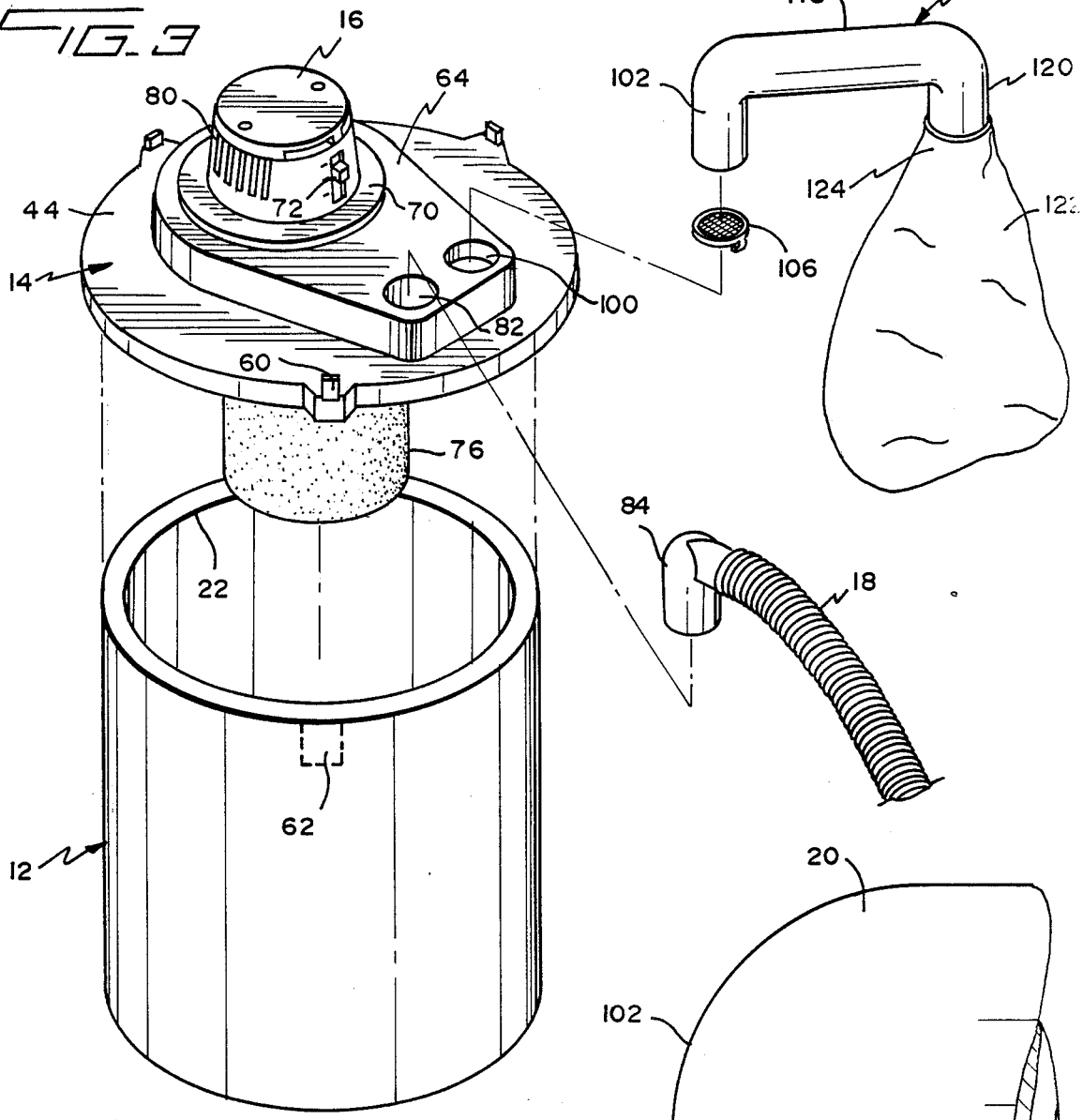
FIG. 4
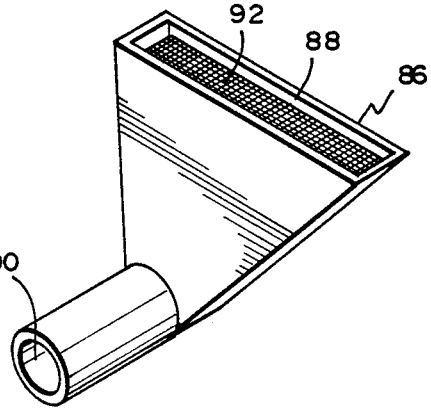
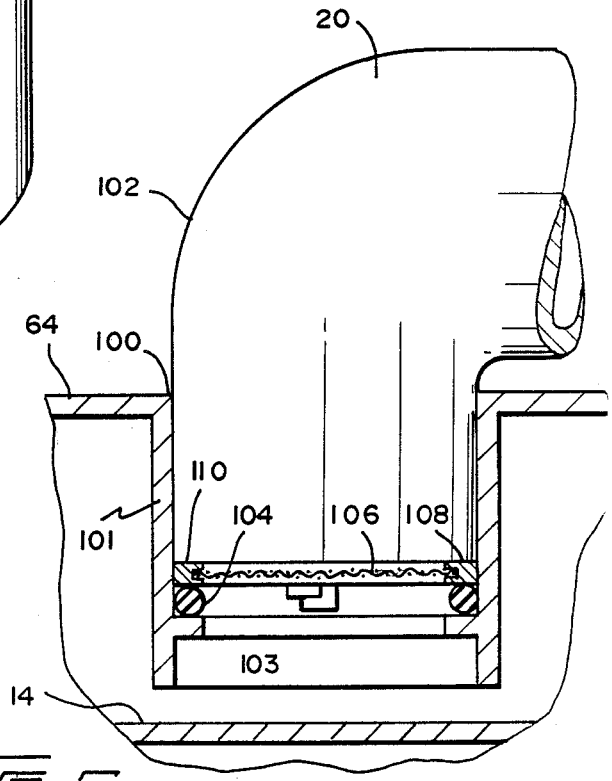
FIG. 5

PORTABLE HOT ASH VACUUM

BACKGROUND OF THE INVENTION

1. Field of the Invention

This invention pertains to vacuum devices especially those for use in removing hot ash and debris from wood or coal-burning stoves, furnaces and fireplaces.

2. Background of the Prior Art

The prior art discloses a suction apparatus for removing ash from an ash pit to a bin. Dust collectors for furnaces are known as well as dust eliminators for dust bins. Auger devices also have been used in this field.

Representative of the prior art patents are listed below and copies are furnished herewith for the record.

| | | |
|---|---|---|
| McMillan | 2,239,010 | Ash Remover |
| Black | 2,487,689 | Furnace Dust . . . Collector |
| Rentz | 2,529,965 | Dust Eliminator |
| Johnson | 4,497,308 | Ash Receptacle |
| Metelko, Jr. | 4,704,764 | Ash Disposal Device |
| Murphy | 4,735,189 | Portable Ash Auger |

SUMMARY OF THE INVENTION

This invention provides a novel, useful and inexpensive vacuum device for removing hot ash from furnaces, stoves and fireplaces.

It is one object of this invention to provide a portable vacuum device useful for removing hot ash from furnaces, stoves and fireplaces.

It is another object of this invention to provide a novel portable vacuum canister for removing hot ash having as components thereof plural concentric housings having a dead air space therebetween to provide an insulation component between the inner and outer housings.

It is yet another object of this invention to provide a portable vacuum canister for removing hot ash having a layer of insulation material covering the entire area of the outer wall of the inner housing, thus providing another different insulation component to ensure optimum heat insulation for the outer wall of the outer housing.

Another object of this invention is to provide a flexible hose for the vacuum comprised of a suitable material and thickness to ensure safe handling thereof while hot ash is being conveyed to the canister.

Still another object of this invention is to provide means for filtering and catching dust generated as the ash enters the inner housing.

These and other objects of the invention will become apparent to those having skill in the art to which the invention pertains from a reading of the following specifications when taken in light of drawings annexed herewith.

BRIEF DESCRIPTION OF THE DRAWINGS

FIG. 3 is a perspective view of the components of the vacuum in exploded form.

FIG. 4 is a view of the details of the nozzle of the flexible hose.

FIG. 5 is a side view in section of the details of the dust collector.

DETAILED DESCRIPTION OF THE DRAWINGS AND THE PREFERRED EMBODIMENT OF THE INVENTION

Figure 1:
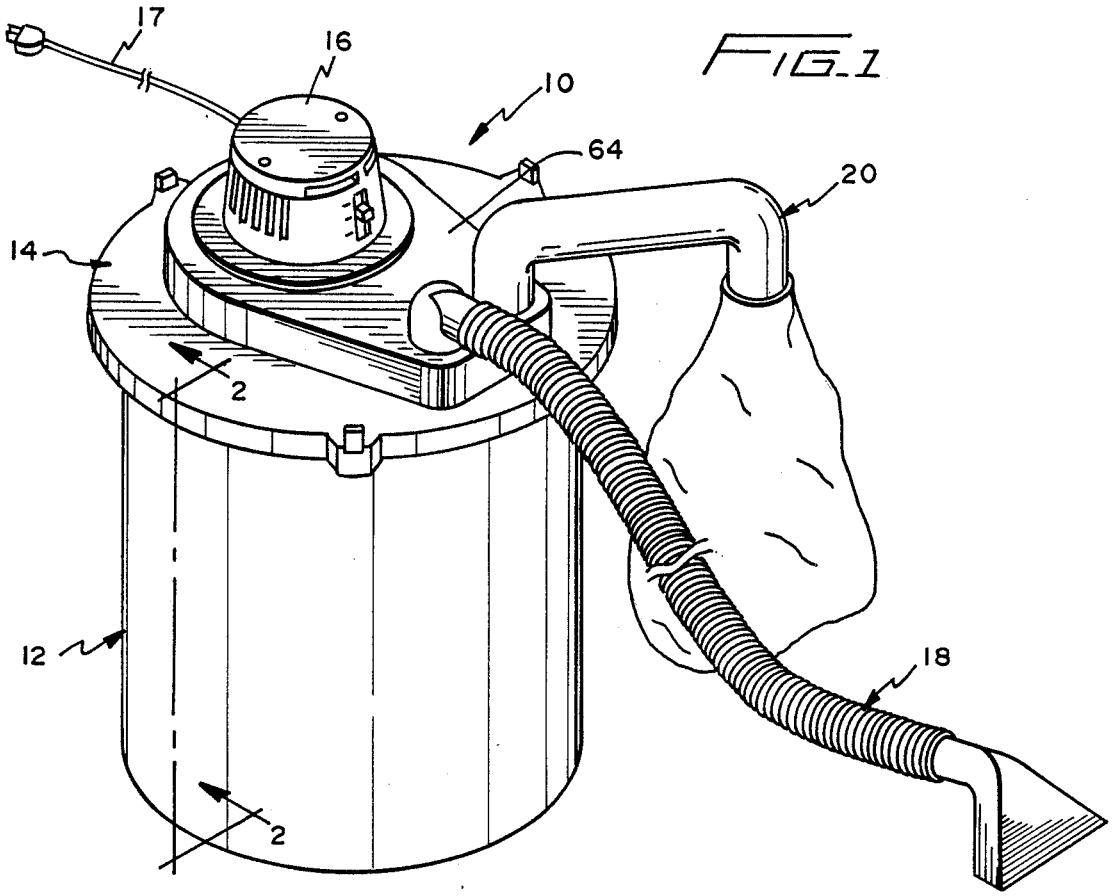
FIG. 1 is a perspective view of the invention showing a vacuum canister, flexible hose with nozzle and dust collector.

Referring now in more detail to the drawings, FIG. 1 shows a vacuum device 10 comprising an outer housing 12, top lid 14, motor 16, flexible suction hose 18, and discharge fitting or dust catcher 20. The structure thus described is identical to the Wet-Dry SHOP-VAC made by SHOP-VAC CORP. of Williamsport, Pa., under model number 600A, which has been commercially available for several years. In this model vacuum cleaner, the suction or inlet opening communicates through the platform and lid 14 to the interior of the canister, and thus to the suction side of motor 16, while the discharge port communicates with the space between the platform and lid, and thus with the discharge side of the motor 16.

Figure 2:
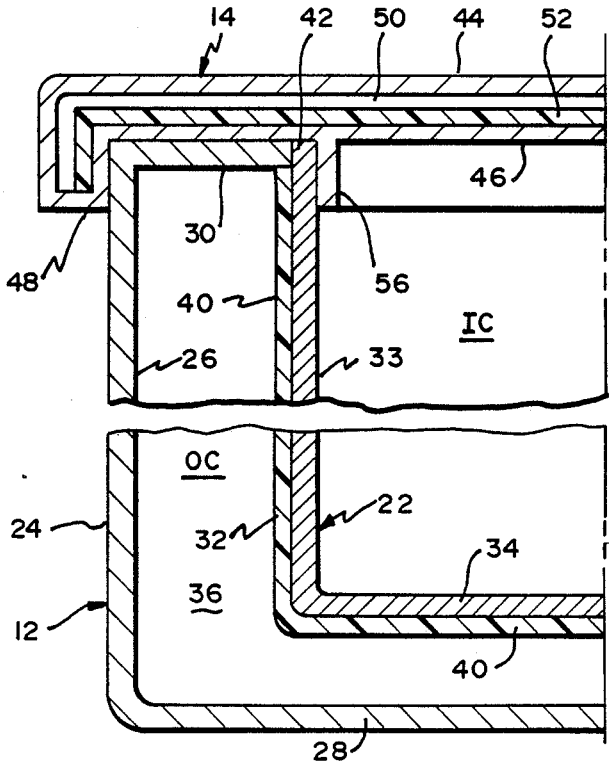
FIG. 2 is a side view of the canister in section taken along the line 2—2 of FIG. 1.

In accordance with the invention, the conventional Shop-Vac as described above is modified by providing the vacuum canister with an inner concentric housing 22, FIG. 2. In the invention, the canister 12, FIG. 2, comprises an outer housing having a continuous outside side wall 24, an inner wall 26 and a bottom wall 28, defining an outer chamber OC. The walls 24 and 26 terminate in an inturned flange 30 which is continuous with said walls. Similarly, the inner concentric housing 22 has a continuous outside wall 32, inside wall 33 and a bottom wall 34, defining an inner chamber IC for receiving hot ash. The inner concentric housing is spaced from the inner wall 26 and bottom wall 28 of the outer housing. The space 36 between the inner housing and outer housing provides a dead air space which functions to prevent or eliminate heat passing from the inner housing to the outer housing, thus ensuring safe handling of the vacuum canister as it receives hot ash.

As an additional safety measure, the outer continuous walls 32 and 34 of the inner housing 22 are covered with an insulation material 40 of sufficient thickness to ensure maximum insulation and prevention of heat from passing from the inner housing to the outer housing. The insulation material 40 completely covers the wall 32 and wall 34, and may be comprised of plastic, rubber, metal or cermentitious material having maximum heat insulation properties. The inside wall 33 will be made of a non-consumable material. In this regard, the wall 33 may have a coating of galvanized material thereon or other suitable material, such as ceramic, etc.

It will be seen from FIG. 2 that the inner housing 22 is secured to the outer housing 12 at the juncture 42 of the flange 30 and wall 32. The fastening means may be by welding or the like to ensure a tight seal for the dead air space 36.

FIGS. 2 and 3 show the cap or lid 14 for the canister 12 comprising an outer wall 44, an inner wall 46 joined together by an inturned and upturned flange 48. The lid 14 is typically a stamped-out one piece item which will have a dead air space 50 between the walls thereof. As in the inner housing construction, an insulation material 52 completely covers the outside of wall 46. The dead air space 50 and insulation 52 function to eliminate heat transfer from the inner housing to the outer wall 44 of the lid while the canister is receiving hot ash.

The cap or lid 14 has continuous down-turned projecting flange 56 which cooperates with flange 48 to provide a tight fit between the inner and outer housings. Latches 60 cooperate with catches 62 to provide means for holding the lid and canister in tight-fitting relationship.

The lid 14 has a platform 64 integral therewith. This construction provides the lid with a suitable thickness for supporting the motor 16 in through-hole 70, FIG. 3. The motor 16 has a variable position switch 72 to facilitate speed change. Attached to the motor 16 beneath the lid 14 is a filter mechanism 76. The motor 16 has ventilation openings 80 for circulation of ambient air to aid in cooling the motor.

The lid 14 has a second through-hole opening 82 communicating with the interior of the inner housing. Opening 82 receives the coupling end 84 of hose 18 in a tight fitting manner to ensure a complete vacuum in the inner housing. The opposite end of the hose 18 has a nozzle 86 which may be of any configuration. The nozzle 86 has an opening 88 which communicates with the passage 90 of hose 18. A suitable filter 92 is positioned across the opening 88 to prevent hot cinders or large hot ash from entering the hose and passing into the inner housing 22.

The lid 14 has a third through-hole opening 100 (which communicates via the space between platform 64 and lid 14, and thence through the discharge side of the motor, with the interior of the inner housing.) Opening 100 has a wall 101, FIG. 5, with a laterally projecting flange 103. This opening is the exhaust port and receives dust filter and collector 20. Member 20 has a hollow coupler 102, FIGS. 3 and 5, which is received in opening 100 in a tight-fitting manner. The lateral flange 103 supports a sealing O-ring 104 which in turn supports a filter 106 secured to a ring 108. The end 110 of coupler 102 rests in compression fashion against ring 108, O-ring 104 and flange 103. This ensures a complete seal for exhaust port 100 and coupler 102. The filter 106 may be of any suitable material having the property of filtering hot dust exiting the inner housing through port 100 to a dust catcher. A very fine mesh metal screen may be used. Alternatively, multiple fine mesh screens may be used in off-set arrangement to effect maximum filtering.

Extending away from hollow coupler 102 is a horizontal hollow tubular member 118 having a downward hollow projection 120 which is parallel to coupler 102. A dust catcher 122 has its neck 124 secured to the end of member 120 in a tight-sealing arrangement.

In operation, the nozzle 86 is placed in the hot ash and the motor 16 is turned on by switch 72. Hot ash will be sucked into the nozzle and through the flexible hose into the inner housing 22. As dust is generated in housing 22, it is forced out exhaust port 100 and through member 20 into dust catcher 122.

Since the inner housing 22 and cap 14 have insulation thereon and dead air spaces, little or no heat passes to the outer walls of the outer housing and cap. This arrangement ensures safe handling of the vacuum canister during the vacuuming of hot ash from stoves, furnaces, fireplaces, etc.

While the invention has been described with respect to a preferred embodiment thereof, it will be appreciated by those skilled in the art to which the invention pertains that numerous structural changes may be made thereto without departing from the spirit and scope thereof.

What I claim is:

1. A portable vacuum cleaner for vacuuming hot ashes, comprising:

a canister having an outer housing and an inner housing;

said inner and outer housings each having side walls, a bottom wall, and a top wall;

at least the side walls and bottom wall of the inner housing being spaced inwardly from the side walls and bottom wall of the outer housing, defining a dead air space therebetween;

vacuum producing means supported on said canister for producing a vacuum to vacuum up ashes and deposit them in said inner housing, said vacuum producing means comprising a motor having a suction side communicating with the interior of the inner housing, and a discharge side communicating with ambient atmosphere; and thermal insulating material on the side and bottom walls of one of said inner and outer housings for cooperating with said dead air space to thermally insulate the temperature of hot ashes in the inner housing from the walls of the outer housing.

2. A portable vacuum cleaner as claimed in claim 1, wherein:

said inner and outer housing top walls are radially spaced from one another, defining a dead air space between the top walls of the inner and outer housings.

3. A portable vacuum cleaner as claimed in claim 2, wherein:

thermal insulating material is on the top wall of one of said inner and outer housings to prevent the temperature of hot ashes in the inner housing from reaching the top wall of the outer housing.

4. A portable vacuum cleaner as claimed in claim 3, wherein:

the vacuum producing motor is supported on the top wall of the inner and outer housings; and a dust collection means is connected with the discharge side of the motor to catch dust expelled from the canister when ashes are being vacuumed.

5. A portable vacuum cleaner as claimed in claim 4, wherein:

the thermal insulating material is on an outer surface of the walls of the inner housing.

6. A portable vacuum cleaner as claimed in claim 9, wherein:

a thermally insulated suction hose is connected with the suction side of said motor; and perforated filter screens are positioned on both the intake and discharge sides of the motor for preventing large coals from being vacuumed into the suction hose, and for preventing large particles from being expelled from the canister through the discharge opening.

* * * * *